US008001898B2

(12) United States Patent
Türke et al.

(10) Patent No.: US 8,001,898 B2
(45) Date of Patent: Aug. 23, 2011

(54) METHOD FOR ADJUSTING AN INKING UNIT OF A PRINTING PRESS

(75) Inventors: Thomas Türke, Lonay (CH); Harald Heinrich Willeke, Paderborn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 267 days.

(21) Appl. No.: 12/225,427

(22) PCT Filed: Mar. 13, 2007

(86) PCT No.: PCT/EP2007/052327

§ 371 (c)(1),
(2), (4) Date: Sep. 22, 2008

(87) PCT Pub. No.: WO2007/110317

PCT Pub. Date: Oct. 4, 2007

(65) Prior Publication Data

US 2010/0116164 A1 May 13, 2010

(30) Foreign Application Priority Data

Mar. 28, 2006 (DE) ..... 10 2006 014 657

(51) Int. Cl.
*B41F 31/02* (2006.01)
*B41F 33/00* (2006.01)
*B41F 31/04* (2006.01)

(52) U.S. Cl. .. 101/484; 101/365; 101/485; 101/DIG. 47

(58) Field of Classification Search ..... 101/365, 101/DIG. 47, 484, 485, 364
See application file for complete search history.

(56) References Cited

U.S. PATENT DOCUMENTS

| | | | |
|---|---|---|---|
| 4,200,932 | A | 4/1980 | Schramm et al. |
| 4,660,159 | A | 4/1987 | Ott |
| 4,665,496 | A | 5/1987 | Ott |
| 4,784,060 | A | 11/1988 | Weisgerber et al. |
| 5,122,977 | A | 6/1992 | Pfeiffer |
| 5,170,711 | A | 12/1992 | Maier et al. |

(Continued)

FOREIGN PATENT DOCUMENTS

| | | | |
|---|---|---|---|
| DE | 27 28 738 | A1 | 6/1977 |
| DE | 30 28 025 | A1 | 7/1980 |
| DE | 30 40 455 | A1 | 12/1981 |

(Continued)

*Primary Examiner* — Daniel J Colilla
*Assistant Examiner* — Leo T Hinze
(74) *Attorney, Agent, or Firm* — Jones, Tullar & Cooper, P.C.

(57) ABSTRACT

A method is used for adapting an inking unit of a printing press. During a setup phase for the printing press, at least a first actual value with regard to an ink application that is set at the inking unit and that is applied to the printed material, is determined by use of a first measuring device. The inking unit is initially set using this first actual value. During continuous printing of the printing press, a plurality of second actual values, with respect to a printed image formed on the printed materials, are determined using a second measuring device which is different from the first measuring device. These second values are fed to an ink adapting device for the inking unit. At least one of these several actual values, which corresponds to the setting mode in the setting phase, is set in the ink adjusting device as its setpoint value. The ink adjusting device detects deviations of the other second actual values for this setpoint value and adjusts the inking unit to minimize these deviations.

9 Claims, 2 Drawing Sheets

U.S. PATENT DOCUMENTS

| | | | | | |
|---|---|---|---|---|---|
| 5,724,437 | A | | 3/1998 | Bucher et al. | |
| 5,967,050 | A | * | 10/1999 | Seymour | 101/484 |
| 6,041,708 | A | * | 3/2000 | Kipphan et al. | 101/365 |
| 6,142,078 | A | * | 11/2000 | Lachajewski | 101/484 |
| 6,422,142 | B2 | * | 7/2002 | Steinbacher | 101/211 |
| 7,398,733 | B2 | * | 7/2008 | De Vries et al. | 101/484 |
| 7,464,645 | B2 | * | 12/2008 | Jeschonneck et al. | 101/484 |
| 7,515,267 | B2 | * | 4/2009 | Ehbets et al. | 356/416 |
| 2007/0079717 | A1 | | 4/2007 | De Vries et al. | |
| 2007/0081204 | A1 | | 4/2007 | Ehbets et al. | |

FOREIGN PATENT DOCUMENTS

| | | | |
|---|---|---|---|
| DE | 34 38 325 | A1 | 10/1984 |
| DE | 38 12 099 | A1 | 10/1989 |
| DE | 40 04 056 | A1 | 8/1991 |
| DE | 43 21 177 | A1 | 1/1995 |
| DE | 10 2004 021 601 | | 12/2005 |
| EP | 0 142 470 | A1 | 10/1984 |
| GB | 2 071 573 | A | 9/1981 |
| GB | 2 165 801 | A | 11/1984 |
| WO | WO 2005/108083 | A1 | 11/2005 |

* cited by examiner

METHOD FOR ADJUSTING AN INKING UNIT OF A PRINTING PRESS

CROSS-REFERENCE TO RELATED APPLICATIONS

This application is the U.S. national phase, under 35 USC 371, of PCT/EP2007/052327, filed Mar. 13, 2007; published as WO 2007/110317 A1 on Oct. 4, 2007 and claiming priority to DE 10 2006 014 657.3, filed Mar. 28, 2006, the disclosures of which are expressly incorporated herein by reference.

FIELD OF THE INVENTION

The present invention is directed to a method for adjusting an inking unit of a printing press. During a setup phase for the printing press, at least one first actual value, with respect to an inking, is adjusted in the inking unit and is applied to at least one substrate. This first actual value is determined by a first measuring device. During a production run, a plurality of second actual values, with respect to an inked print image on the substrate, are acquired by a second, different measuring device.

BACKGROUND OF THE INVENTION

A method for adjusting an inking unit of a printing press is known from EP 0 142 470 A1. Actual reflection values for a printed sheet are determined outside of the printing press via a scanning device, such as, for example, via a plate scanner. Reflection setpoint values of other printed sheets from this printed product are measured, using a densitometer, as the printing press is running. The actual reflection values and the reflection setpoint values are compared with one another in a computer. From the results of this comparison, setpoint values for adjusting the inking unit are calculated. The inking is thus controlled.

A method for adjusting an inking unit of a printing press is known from GB 2 071 573 A. Spectral data on a printed product, acquired inside and outside of the printing press, in both cases using a densitometer, are compared. The comparison values are used to readjust the inking unit.

A method for determining color and/or density values for the monitoring and/or control of the printing process in a printing unit is known from WO 2005/108083 A1 for use especially in a sheet-fed offset printing press. Measuring fields of a printed sheet are measured during the printing process photoelectrically, directly in or on the running printing device. From the measured values, which are obtained in this manner, the color and/or density values for the relevant measuring fields are formed. Measured value deviations, caused by the measurement directly in the printing process with respect to a measurement outside of the printing process, are corrected computationally.

A device for inspecting the image and measuring the color of at least one printed product produced in a printing press is known from DE 43 21 177 A1. The device is comprised of at least one imaging device which supplies image data from the printed product, and a computer device. The computer device acquires all image data from the printed product for the purpose of an image inspection, and uses this image data to determine a measured value for a color evaluation of at least one measuring point, such as a pixel, on the printed product.

A device for metering ink in a printing press, especially a sheet-fed offset printing press, is known from DE 30 40 455 A1. The printing press is comprised of one or more printing units, each of which contains an inking unit and a plurality of cylinders. A densitometric measuring device, for use in measuring the color density of color test areas of the printed product, is situated on at least one cylinder, against which the printed product lies with a surface that is partially printed facing outward. A control device, having a predetermined setpoint value, is connected to the densitometric measuring device. A setpoint value for the control device is supplied to an adjustment element of the inking unit or inking units. Preferably, a final proof is fed through the printing press without a printing run. The color density of the color test areas of the final proof, as measured by the densitometric measuring device, is input into the control device as a setpoint value.

A method for controlling color in a printing press is known from DE 38 12 099 A. Measuring fields on the sheets printed in the printing press are optically scanned. The actual color locus determined for a measuring field via the scanning process is compared with a predetermined setpoint color locus. Ink metering elements of the printing press are controlled so as to decrease the color deviations.

A method of color control and of the zonal presetting of ink metering elements in inking units of rotary printing presses, and especially in inking units of rotary offset printing presses, is known from DE 40 04 056 A1. Printed images, which are produced by the printing press, are scanned, for example via densitometric or colorimetric devices. Values, which are obtained in this manner, can be fed to a computer that determines the ink requirement, using a print substrate scanning logic with a self-learning system or a so-called expert system. During a pre-print run phase, and also during a production run phase, the setpoint values can be continuously updated.

An inline color measuring system for a printing press is known from DE 10 2004 021 601 A1. This system uses a CCD image sensor, for example, to detect spectral, densitometric or color measured values on sheet-type print substrates during production runs. These measured values are used as control parameters for controlling the printing process. The inline color measuring system is calibrated; for example, by feeding measured values, which have been determined offline using a hand-held densitometer, directly to the measuring electronics of the inline color measuring system.

SUMMARY OF THE INVENTION

The object of the present invention is to devise a method for adjusting an inking unit of a printing press. A level of print quality to be produced by the printing press can be adjusted, and especially can be controlled, via an intervention, and especially via a controlling intervention in the inking unit of the printing press. This can be accomplished despite the use of different measuring processes during a setup phase for the printing press and during its production run, and without requiring a computer intensive conversion of the measured values from the measuring process, which had been used during the setup phase, to the measuring process which is used during the production run.

The object is attained according to the invention by the determining of at least one first actual inking value, adjusted in the inking unit of the printing press and applied to the print substrate, using a first measuring device. The first actual value is used in the inking unit and is adjusted. During a production run of the printing press, a plurality of second actual values, with respect to a print image printed on the substrate, are acquired using a second measuring device, different from the first measuring device. These second values are fed to an adjustment device that adjusts the inking unit. At least one of the second values, which corresponds to the setting of the inking on the substrate during the setup phase, is set in the adjustment device as its setpoint value. The adjusting device detects deviations of the other second values and readjusts the inking unit.

The benefits to be achieved with the present invention consist especially in that an adjustment of an inking application, to be applied to a print substrate using at least one inking unit of the printing press, with that adjustment being performed during a setup phase of the printing press, and using a first measuring device, which first measuring device is preferably arranged outside of the printing press, establishes a level of print quality to be produced by the printing press. The level of print quality, which is established in this manner, is used to establish a setpoint value for a control device of a second measuring device. The control device controls at least the one inking unit, for example. The second measuring device is different from the first measuring device and is especially arranged inside the printing press. It is preferably a part of an inline inspection system that uses a camera to record images of a printed image on the print substrate. An actual value, which corresponds to the level of print quality to be produced and which is acquired using the second measuring device, is established during an early phase of the production run of the printing press, and preferably is established at its start. This initial actual value is used as a setpoint value for the adjustment device, or for the control device. In the subsequent production run on the printing press, which production run follows the establishment of this setpoint value, actual values, that are acquired by the second measuring device, require no special processing in terms of a conversion or transformation in order to be suitable for the adjustment or control of the inking unit. A suitability of the measured values presupposes their direct comparability. In other words, there must be a comparability of the actual values acquired using the second measuring device during the production run with the setpoint value established in the adjustment device or in the control device.

To avoid a computationally intensive and therefore a time-consuming adaptation of the measured values, actual values, which are acquired at a later time and using the second measuring device, such as, for example, following the establishment of the setpoint value with respect to the second measuring process, are instead compared solely with an earlier actual value which was also received from this second measuring device. Accordingly, only similar measured values are subjected to comparison. Because the setpoint value for the adjustment device or for the control device is established on the basis of the level of print quality to be produced and not directly using the measured values from the first measuring device, the first measuring device, which had been used during the setup phase, and the second measuring device, which is being used during the production run, are free to use completely different measuring processes. This is in keeping with the real situation in a print shop operation. Despite an incompatibility of the measured values from these two respective measuring processes, these values are nevertheless suitable for ensuring a consistently high level of print quality, in accordance with the process of the present invention. The first measuring device can employ, for example, a densitometric measuring process. The second measuring device is preferably configured, for example, as a photographic system, and especially is configured as a camera system. The adjustment device or the control device, which is allocated to the inking unit of the printing press and which is connected to the second measuring device, detects and/or identifies deviations in the images, which have been recorded by the second measuring device, especially through the use of an image comparison. Deviations in images, which have been recorded as the actual value from an image established as the setpoint value, with those deviations being detected through the image comparison, are interpreted as a change in the level of print quality being produced. Such changes in the level of print quality are controlled in terms of a minimization of these deviations. In the method in accordance with the present invention, ink density values for the inking applied on the print substrate, and determined using the first measuring device via a densitometric measuring process, for example, do not have to first be converted to image data in order to be evaluable by the second measuring device, which second measuring device is being used during the production run.

With the method in accordance with the present invention, a basic adjustment of the printing press is executed with the first measuring process used during the setup phase. The establishment of a setpoint value for the second measuring process, which is active during the production run, then builds upon an optimal adjustment of the printing press obtained using the first measuring process. The measured values, which were obtained from the first measuring process, are not converted to measured values that can be processed in the second measuring process. Therefore, the origin of the setpoint is the primary determining factor in establishing the setpoint value in the second measuring process. The first measuring process, which was used during the setup phase, is used to establish a reference point for the second measuring process, which is active during the production run.

The method in accordance with the present invention therefore results in a rapid-reaction color adjustment, such as preferably a color control of a printing press. A high degree of flexibility in the use of the measuring elements is provided.

The method for color control of a printing press, in accordance with the present invention, executes essentially the following process steps in sequence:

In a setup phase for the printing press, a first actual value, with respect to an inking which is applied to a print substrate and which is adjusted on at least one inking unit of the printing press, is first determined using a first measuring device. This first measuring device is preferably arranged outside of the printing press.

Using this first actual value, the at least one inking unit, which applies the inking to the print substrate, is then adjusted for a level of print quality to be produced by the printing press. This occurs especially if the determined first actual value indicates a need for a correction with respect to the level of print quality to be produced by the printing press. The existence of the need for such a correction can be evaluated by the printing press operator or by the use of a mechanical device, such as, for example, through a comparison of the acquired first actual value with, for example, data relating to the level of print quality to be produced, as may be known, for example, from a prepress run.

In a production run on the printing press, which production run follows the setup phase, a plurality of second actual values, with respect to the inking applied to the print substrate, are then acquired through the use of a second measuring device. This second measuring device is different from the first measuring device and is preferably situated inside the printing press. These values are supplied to an adjustment device which participates in adjusting the at least one inking unit of the printing press, Alternatively, these values may be supplied to a control device which participates in controlling the at least one inking unit of the printing press.

In an early phase of the production run, at least one of the second actual values is acquired using the second measuring device. This second actual value corresponds to the last adjustment of the inking applied to the print substrate, as made during the setup phase with respect to the level of print quality to be produced in the printing press. This early production run second value is established as the setpoint value in the adjustment device or in the regulating control device which is used to adjust the at least one inking unit of the printing press.

The control device then preferably determines a deviation of other second actual values, acquired during the production run on the printing press, from the established setpoint value. Such deviations are controlled by readjusting the at least one inking unit of the printing press, which applies the ink to the print substrate, in order to obtain a minimization of this deviation that has been detected by the control device. Alternatively, the readjustment of the inking unit that applies the ink to the print substrate is accomplished in that, as previously was done during the setup phase of the printing press with the first measuring device, another first actual value, with respect to the inking currently being applied to the print substrate by the inking unit of the printing press is acquired. Now, using this additional first actual value, the inking unit, which applies the ink to the print substrate, is adjusted with respect to the level of print quality to be produced by the printing press. This is done by way of a minimization of the deviation that has been detected and/or that has been identified during the production run on the printing press by the adjustment device or by the control device.

In this method, the first actual value, which was acquired by use of the first measuring device during the setup phase of the printing press is acquired, for example, by densitometric and/or colorimetric procedures. The acquisition of the second actual value, which is preferably acquired within the printing press during its production run, is accomplished, for example, using a second measuring device which is embodied, for example, as a camera, which is preferably embodied as a color camera. The camera records, for example, a print image which has been printed on the print substrate, or which has been printed on a printed measuring strip. The second actual value, which is acquired during the production run on the printing press, is acquired, for example, through the use of a second measuring device, which may be embodied, for example, as an inline inspection system.

During the setup phase of the printing press, the first actual value, which is determined using the first measuring device can, for example, also be detected on a plurality of copies of the print substrate which have been provided with the ink application. A mean value of these actual values can be calculated. Using this calculated mean value, the application of ink on the print substrate is adjusted, with respect to the level of print quality to be produced by the printing press.

The second measuring device, which is active during the production run of the printing press, can also be used to acquire a limited number of second actual values. Each of these second actual values corresponds to the adjustment of the inking on the print substrate, with respect to the level of print quality to be produced by the printing press. This adjustment can have been made during the setup phase. This group of second actual values is used to calculate a mean value. This mean value is then preferably set in the adjustment device or in the control device as its setpoint value.

The first actual value, which corresponds to the adjustment of the inking on the print substrate, was made with respect to the level of print quality to be produced in the printing press, and was acquired during the setup phase of the printing press via the first measuring device. This first actual value is transmitted, using electronic data transmission, to a central control console for the printing press and/or to the second measuring device and/or to the adjustment device or to the control device.

The adjustment device or the control device can display the detected or the identified deviation of the second actual value, acquired during the production run of the printing press, from the established setpoint value. Such a display can be provided on a display element which is a part of the central control console of the printing press, for example. Such a deviation can also be signaled using a signalling device.

The adjustment device or the control device, which controls the detected or the identified deviation of the second actual value, acquired during the production run of the printing press, from the established setpoint value, may operate either automatically or only after manual confirmation of the deviation.

The adjustment device or the control device, which controls the detected or the identified deviation of the second actual value, acquired during the production run of the printing press, from the established setpoint value may be structured to operate only when the deviation value reaches or exceeds a predetermined tolerance limit for the degree of deviation.

BRIEF DESCRIPTION OF THE DRAWINGS

One preferred embodiment of the present invention is represented in the set of drawings and will be described in greater detail in what follows.

The drawings show in:

FIG. 1 a schematic side elevation view of a printing press; and in

DESCRIPTION OF THE PREFERRED EMBODIMENT

Figure 1:
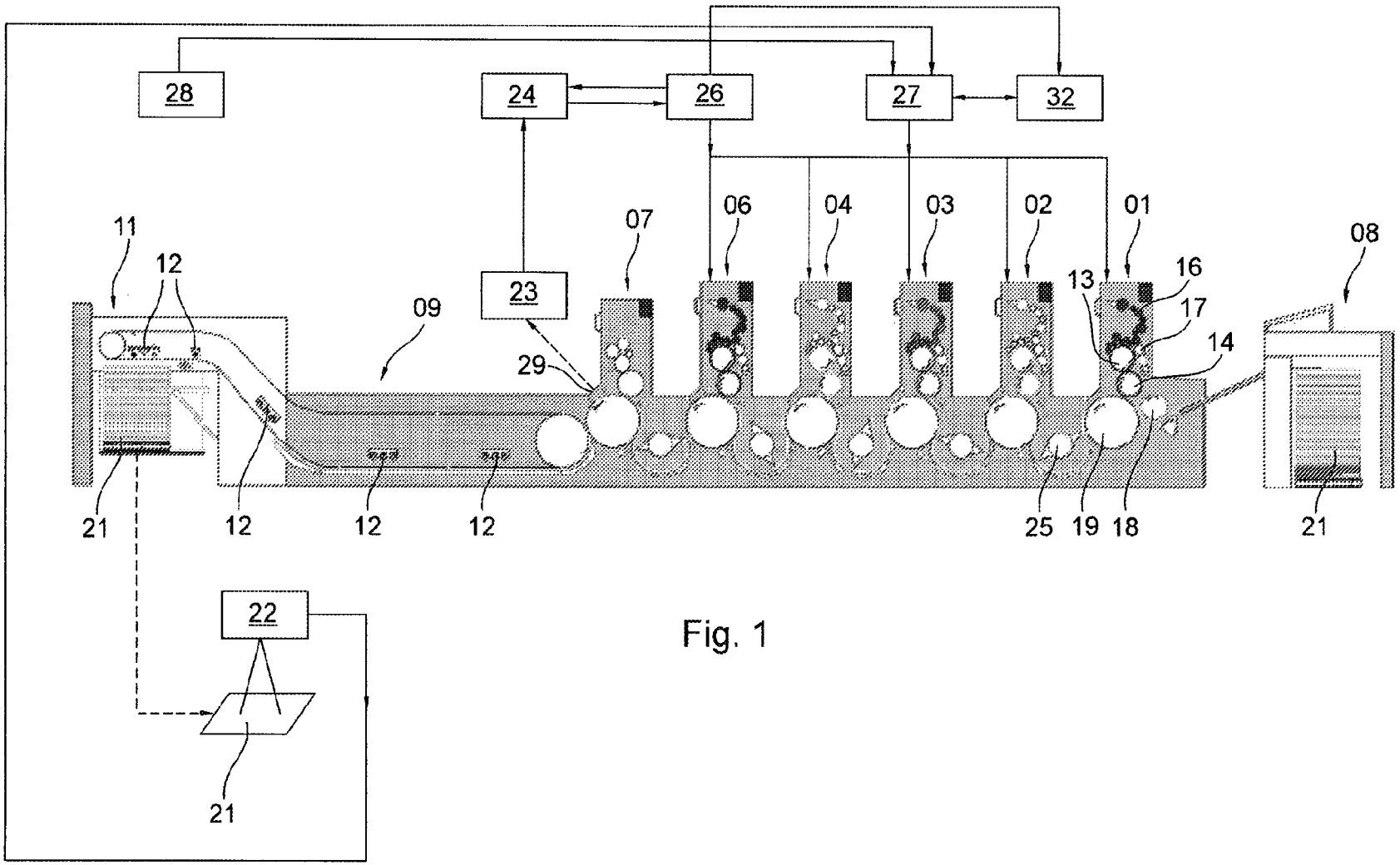

Referring initially to FIG. 1, there may be seen a sheet-fed printing press, which is shown, by way of example, as the printing press. This sheet-fed printing press is configured, for example, as a five-color printing press. Beginning with a sheet infeed unit 08, the sheet-fed printing press is configured with five printing couples 01; 02; 03; 04; 06 which are arranged, in this embodiment, one after another in a direction of production. The five printing couples are followed by a tower coater 07 and by a delivery extension 09, which are arranged in sequence. In an ascending branch of a chain segment in the delivery extension 09, a chain guide stabilizes the transport of a sheet 21 to be transported to the delivery unit 11. The print substrate 21, which is embodied as a sheet 21, is stacked both in the sheet infeed unit 08 and in the delivery unit 11. In the area of the delivery extension 09, a plurality of dryers 12 are preferably arranged, which dry freshly printed sheets 21 as they are transported in the delivery extension 09. These dryers operate, for example, using infrared radiation, heated air, or UV radiation.

The sheet-fed printing press prints the print substrate 21, for example, in an offset printing process. In each printing couple 01; 02; 03; 04; 06, one forme cylinder 13 and one transfer cylinder 14 work together. An inking unit 16, comprising a plurality of rollers, and preferably also a dampening unit 17 are arranged for cooperation with each forme cylinder 13. The inking unit 16 has a plurality of inking zones which are arranged in a row in an axial direction of the forme cylinder 13. There may be, for example, thirty or more of these ink zones, each having a width, for example, of 30 mm, which ink zone width for each ink zone width can be adjusted, in accordance with respect to a coating thickness of the printing ink to be applied by the inking unit 16 to the print substrate 21, via an adjustment element, for example a zone ductor. The ink zone width can be adjusted preferably via a remote adjustment that can be implemented from a central control console 27, such as, for example, a control panel 27.

A sheet 21 to be printed is fed, in the direction of production, from the sheet infeed unit 08 to the first printing couple 01 via an infeed drum 18. The sheet 21 is printed in the printing gap between the transfer cylinder 14 and a printing or counter-pressure cylinder 19 that cooperates with this transfer cylinder 14. Sheet 21 is then transferred, via a transfer drum 25, to the next printing couple 02 in the direction of production, where the sheet 21 is now printed with another printing ink. The printing press can also have a turning drum, which is not specifically shown, for use in implementing straight printing and verso printing to accomplish a double-sided printing of the sheet 21. In the case, ten printing couples 01; 02; 03; 04; 06 are arranged in a row in the printing press in its direction of production, for example.

In a setup phase of operation of the printing press, for example, one of the first sheets 21, which has been printed in the printing press, is preferably removed at the delivery unit 11, and is inspected by the use of a first measuring device 22. The first measuring device 22 is preferably situated outside of the printing press and is usable to determine the level of quality produced on the first sheets 21 by the printing press. This sheet removal of one of the first sheets 21 is indicated in FIG. 1 by a dashed line. During the setup phase of operation of the printing press, for example, a single sheet 21 or a small number of sheets 21 are preferably transported through the printing press at a significantly slower speed than the speed which will be utilized as the production speed during a production run.

The first measuring device 22 is embodied, for example, as a densitometer, and may be configured, for example, as a hand-held densitometer, or as a color spectrometer or as a combination measuring instrument for a densitometric and a colorimetric measurement. This first measuring device 22 is accessible, for example, at, or close to, a central control console 27 which is assigned to the printing press. Using at least one measured value, which has been acquired via the first measuring device 22, such as, for example, an acquired actual value for a certain measured variable, such as, for example, the coating thickness of a certain ink color or an actual value for its color tone applied to the print substrate 21, the level of quality produced by the printing press is evaluated. This is typically done by comparing the actual measured value with a setpoint value for this measured variable. The inspection of the sheet 21 to be evaluated can relate to the printed image printed on it or can relate to at least a measuring strip that is a part of the printed image. The measuring strip is situated, for example, at the edge of the sheet 21, outside of the range of the printed image. If the actual value, which is determined using the first measuring device 22, deviates from the desired setpoint value by an amount that is greater than an amount which is permitted by a previously established tolerance range for this measured value, a setting of the inking unit 16 of at least one of the printing couples 01; 02; 03; 04; 06 of the printing press is changed. Such a change in the inking unit 16 is made in such a way that an actual value, which is determined on a sheet 21 that is printed after the change in the setting of the inking unit 16, coincides more closely with the predetermined setpoint value for this measured value than was the case with the previous measurement. The adjustment of an inking unit 16 of at least one of the printing couples 01; 02; 03; 04; 06, which adjustment is necessary, based upon a setpoint value/actual value comparison, involves particularly a displacement of the adjustment elements, which are allocated to the respective inking zones, to effect a change with respect to the coating thickness of the printing ink provided there. The first measuring device 22 can convey its measured values to the central control console 27 through an electronic data connection, for example. The setpoint value, for comparison with respect to the measured value acquired by the first measuring device 22, is supplied to the central control console 27, for example, by a computer of the pre-print stage 28. The central control console 27 can also execute the necessary setpoint value/actual value comparison automatically, for example.

When there is sufficient agreement between a measured value of the early printed sheets 21, as acquired using the first measuring device 22, and the predetermined setpoint value for this measured value, the setup phase for the printing press is considered adequately completed. Now, with the current level of adjustment of the respective inking unit 16 of at least one of the printing couples 01; 02; 03; 04; 06, the desired quality of the printed product to be produced by the printing press can be achieved. The printing press can now be released for a production run or in other words can be approved for the transport of the print substrate 21 at a full production speed. The valid setpoint value for the first measuring device 22 can be provided in the pre-print stage 28, for example, using a sample sheet or electronically with data from the computer. The measured values, which are acquired through the use of the first measuring device 22, are referred to as first actual values.

A second measuring device 23 is preferably provided in the printing press and is preferably located on, or adjacent the last printing couple 06 in the direction of production or on the tower coater 07, which tower coater 07 is situated downstream from the printing couples 01; 02; 03; 04; 06. The second measuring device 23 is embodied, for example, as an inline inspection system, and has, for example, at least one camera system and at least one illumination unit. The camera is embodied, for example, as a color camera and is configured, for example, as a line camera or as a surface camera. The camera can have as its image sensor, for example, a CCD chip or a CMOS chip. The illumination unit extends in the axial direction of the forme cylinder 13 of the last printing unit, and preferably over the entire length of the forme cylinder 13. The illumination unit has light-emitting diodes or has laser diodes as its illumination elements, for example, and preferably has a plurality of parallel rows of light-emitting diodes or of laser diodes. The light-emitting diodes or the laser diodes are operated selectively, either pulsed or with permanent light.

The second measuring device 23 records an image of at least one, and preferably of all of the sheets 21 which are transported through the printing press during the production run. The second measuring device 23 particularly detects the print image which has been printed on each of the sheets 21. This second measuring device 23 converts the recorded image preferably to digital image data and feeds this data, for example, to an image processing system 24. The measured values, which are acquired using the second measuring device 23, such as, for example, the electrical image data that correlate with the recorded printed image, are referred to as second actual values. The imaging, which is performed by the second measuring device 23, is indicated in FIG. 1 by a dashed arrow line.

At least one of the second actual values, which is acquired through the use of the second measuring device 23, and which is acquired at the start of, or at least during an earlier phase of the production run, is set as the setpoint value in an adjustment device 26 that adjusts the inking unit 16 of at least one of the printing couples 01; 02; 03; 04; 06, and preferably is received in a control device 26 that controls the inking unit 16 of at least one of the printing couples 01; 02; 03; 04; 06. In one preferred embodiment of the present invention, the control device 26 preferably automatically adjusts, for example, the zone ductors that are assigned to the respective inking zones, for example, through the use of servo drives. The quality of the printed product produced by the printing press, which quality was assessed as good during the setup phase of the printing press, is taught to the adjustment device 26 or to the control device 26. The early phase of the production run therefore represents a learning phase for the adjustment device, or the control device 26, in which early production learning phase, the adjustment device 26, or the control device 26, is configured for the continuation of the production run in the printing press. The configuration of the adjustment device 26, or of the control device 26, and of the at least one inking unit 16 which it controls, can be achieved through an independent implementation of the learning phase, or in connection with an actuation, for example, at the central control console 27. Upon completion of the learning phase, all further printed products, which are produced during the production run, are evaluated on the basis of the setpoint value that was established during the learning phase. If, for example, the image processing system 24 detects a deviation of the second actual values, which was acquired by the second measuring device 23 following the completion of the learning phase, from the setpoint value that was established during the learning phase, and specifically detects a deviation which exceeds a tolerance range that was previously established for the measured value of the second measuring device 23, then the adjustment device 26, which adjusts the inking unit 16 of at least one of the printing couples 01; 02; 03; 04; 06, or the control device 26, which controls the inking unit 16 of at least one of the printing couples 01; 02; 03; 04; 06, preferably begins to change the setting of this at least one inking unit 16. Such a setting change of the at least one inking unit 16 is accomplished in such a way that the second actual values, which are preferably continuously acquired during the production run through use of the second measuring device 23, are moved back closer to the setpoint values that were established for the corresponding measured value.

When a correction is required, the adjustment device 26, or the control device 26, which is guided using the measured values that have been acquired by the second measuring device 23, preferably automatically performs a readjustment of the inking unit 16 of at least one of the printing units 01; 02; 03; 04; 06. The adjustment or control device 26 is therefore overlapped, in its adjustment, or in its control intervention, into the adjustment of the inking unit 16, which was made during the setup phase of the printing press, such as, for example, by the central control console 27. However, the adjustment process, which was implemented in connection with the first measuring device 22, and the adjustment process, which is implemented in connection with the second measuring device 23, are each implemented autonomously. A calculated conversion of measured values from the first measuring device 22, into image data that can be processed by the image processing system 24, for example, is not performed. The initial quality of the printed product to be produced by the printing press, which initial quality is established through the use of the first measuring device 22, is used to establish the setpoint value for the adjustment device 26, which adjustment device 26 or control device 26 is connected to the second measuring device 23. The respective printed image on the sheet 21, which printed image corresponds to the result of the adjustment of the inking unit 16 that is made during the setup phase, becomes the reference variable for the adjustment device 26, or for the control device 26, which is active during the production run. The readjustment of the inking unit 16 of at least one of the printing couples 01; 02; 03; 04; 06, which readjustment must be performed during a production run, when a need for correction is detected, can also now be achieved. The adjustment device 26, or the control device 26, signals the detected deviation of the second actual values, which have been acquired during the production run of the printing press, from the established setpoint value, and/or displays a correction recommendation for the adjustment of the inking zones of the inking unit 16, for example on a display unit 32 of the control console 27. This correction recommendation can be accepted by operators of the printing press through the use of a suitable confirmation, or can be rejected by way of some other input. Because the present invention provides for a non-obligatory readjustment of the inking unit 16, short-term disruptions, which can occur, for example, following a refilling of an inking unit 16 with printing ink, or which can occur in the event of an incorrect quantity of dampening agent, can be ignored. A signalling device can signal the display of the correction recommendation on the display unit. The adjustment device 26, or the control device 26, can be configured to indicate the detected deviation of the second actual value, acquired during the production run of the printing press, from the established setpoint value only upon that detected deviation reaching or exceeding a previously established tolerance limit for the degree of deviation, and/or displays and/or signals and/or controls this detected deviation.

The readjustment of the inking unit 16, which applies the inking to the print substrate 21, can be implemented in such a manner that, as before, during the setup phase of the printing press, another first actual value, with respect to the inking currently being applied to the print substrate 21 by the inking unit 16 of the printing press, is determined, also using the first measuring device 22. Now using this additional first actual value, the inking unit 16, which applies the inking to the print substrate 21, is adjusted with respect to the print quality to be produced by the printing press, in terms of a minimization of the deviation detected during the production run of the printing press by the adjustment device 26, or by the control device 26. In this alternative embodiment of the present invention, the adjustment device 26, or the control device 26, is involved in the adjustment, or in the control, of the print quality to be produced by the printing press, but only as a production monitoring device. This adjustment device 26 or control device 26 preferably detects the deviation on a continuous basis and by scanning all produced copies of the printed product to be produced. The sensed deviation of the printed products from the setpoint value, which was established using the second measuring device 23, results, during the production run of the printing press, for example, from an especially persistent disruption in the ink transport and/or from a disruption in the necessary balance of printing ink and dampening agent. If a deviation is detected, and especially a deviation which exceeds a previously established tolerance limit, the adjustment device 26, or the control device 26, issues a corresponding signal, which is displayed, for example, on the display unit 32 that is a part of the control console 27. The operator can then remove a production-generated sheet 21 from the printing press at the delivery unit 11, can measure this production-generated sheet 21, as before, during the setup phase of the printing press using the first measuring device 22, and can then readjust the inking unit 16 that applies the inking to the sheet 21, for example at the control console 27, with respect to the level of print quality to be produced by the printing press, such a readjustment can be performed in terms of accomplishing a minimization of the deviation, which has been detected by the control device 26 during the production run of the printing press. In most cases, it is unnecessary to halt production in the printing press to perform this readjustment. Using a signal, which is issued by the adjustment device 26, or by the control device 26, to perform the readjustment of the inking unit 16 which applies the inking to the sheet 21, offers the particular advantage that a deviation in the quality of the printed product to be produced by the printing press, which deviation develops gradually during the production run, can be detected significantly earlier and more reliably based upon the measured values acquired by the second measuring device 23, depending upon the preset tolerance limit for this deviation, than is possible based solely upon a monitoring of the production by the press operator. As a result a correction in the setting of the inking unit 16 that applies the inking to the sheet 21 can also be implemented earlier, thereby reducing the number of wasted printed sheets that are produced in the course of a typical production run.

It is advantageous, in accordance with the present invention, to detect a limited number of second actual values during the learning phase, through the use of the second measuring device 23. These second actual values correspond to the adjustment of the inking on the print substrate 21, as made during the setup phase, with respect to an effort to set the print quality to be produced by the printing press. It is of benefit to calculate a mean value from this limited number of detected second actual values, for example in the image processing system 24. This mean value is then set in the adjustment device 26, or in the control device 26, as its setpoint value.

The measured values from the first measuring device 22 can be archived, such as, for example, by the image processing system 24 or in another memory device. The first measuring device 22 need not necessarily execute its measuring process with each pre-print run. Instead, with the execution of a subsequent order that is similar to the previous print order, the adjustment device 26, or the control device 26, can refer to the archived measured values from the first measuring device 22.

Figure 2:
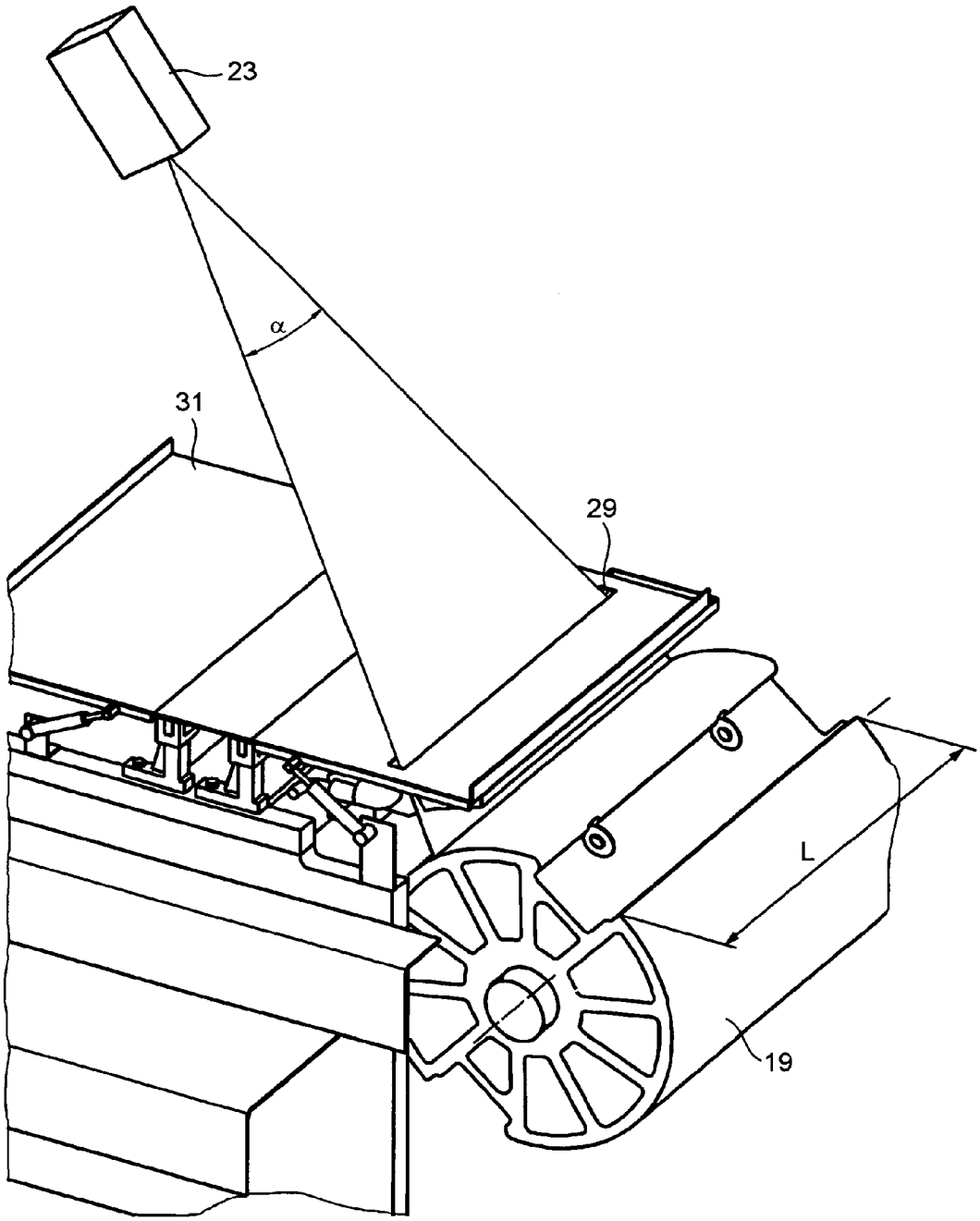
FIG. 2 a perspective representation of an inline inspection system in the printing press for use in accordance with the present invention.

FIG. 2 shows, in a perspective view of a section of the printing press shown in FIG. 1, an arrangement of the second measuring device 23, which may be embodied as a camera. The camera acquires measured values from a sheet 21, being transported along the printing cylinder 19, through a preferably slit-shaped opening 29 which extends in the axial direction of the printing cylinder 19. Slit-shaped opening 29 can be provided, for example, in a treadle 31 on one of the printing couples 01; 02; 03; 04; 06 or on the tower coater 07. The camera has a detection angle $\alpha$ which opens along the axial direction of the printing or counter-pressure cylinder 19. The camera of the second measuring device 23 may be equipped, for example, with a wide angle lens. The printing or counter-pressure cylinder 19 has a length L of, for example, from 300 mm to 2,100 mm, and preferably has a length of, for example, of 700 mm to 1,100 mm, in its axial direction. In the axial direction of the printing or counter-pressure cylinder 19, a plurality of cameras for the second measuring device 23 can also be arranged side by side. The respective detection angles $\alpha$ of each of these cameras then can each cover only a portion of the length L of the printing cylinder 19. The opening width of the detection angle $\alpha$ of each camera can thus be smaller in dimension, thereby making it possible to record images of the printed image on the sheets 21 with less distortion.

While preferred embodiments of a method for adjusting an inking unit of a printing press, in accordance with the present invention, have been set forth fully and completely hereinabove, it will be apparent to one of skill in the art that changes in, for example, the type of ink being used, the number of printing units, the sheet transfer assembly, and the like could be made without departing from the true spirit and scope of the present invention which is accordingly to be limited only by the appended claims.

What is claimed is:

1. A method for adjusting an inking unit of a printing press including:

providing a plurality of printing couples in said printing press with each said printing couple including a forme cylinder usable to form a portion of a printed image to be applied to a print substrate;

using said plurality of forme cylinders in said plurality of printing couples and forming a multicolor printed image having a defined level of print quality on said print substrate printed by said printing press during a setup phase of said printing press;

determining, during said setup phase for the printing press, at least one first actual value of said multicolor printed image and which corresponds to said defined level of print quality of said multicolor printed image and applied to said at least one print substrate by said plurality of forme cylinders in said plurality of printing couples;

providing a first measuring device as one of a densitometer and a colorimeter and using said first measuring device for determining said level of print quality of said multicolor printed image applied to said print substrate during said setup phase of said printing couples;

using this first actual value and adjusting inking units of said printed couples which apply said multicolor printed image to the print substrate and for forming an established setpoint value for said multicolor printed image having said defined level of print quality during the setup phase;

determining, during a production run of the printing press, a plurality of second actual values with respect to said level of print quality of said multicolor printed images which are printed onto the print substrate;

acquiring said plurality of second actual values of said level of print quality of said multicolor printed images applied to said print substrate during said production run of said printing press by using a photographic system as a second measuring device, which second measuring device is different from the first measuring device, said second actual values being incompatible with said first actual values;

feeding said plurality of second actual values to an adjustment device which adjusts each of the inking units of said plurality of printing couples;

using at least an initial one of the second actual values acquired by said photographic system forming said second measuring device, and with said at least one initial one of the second actual values, acquired at the initiation of said production run and corresponding to the setting of the multicolor printed image having said defined level of print quality to be produced on the print substrate and implemented during the setup phase, in the adjustment device, as said established setpoint value;

using the adjustment device and determining a deviation of subsequent other ones of said second actual values of said level of print quality of said multicolor printed image, determined during the production run of the printing press, and deviating from the at least initial one of said second actual values and established setpoint value, said subsequent ones of said second actual values of said level of print quality being compared with said at least one initial one of said second actual values of said level of print quality, all as determined by said second measuring device, in said adjustment devices and without referring to said at least one first actual value determined by said first measuring device during said setup phase of said printing press;

minimizing said determined deviations of said subsequent second actual values from said at least initial one of said second actual value setpoint value by readjusting said inking units of said printing couples which apply the ink to the print substrate for forming said multicolor printed image; and providing said photographic system usable for acquiring the second actual values of said level of print quality of said printing image applied to said print substrate and acquired during the production run of the printing press as an inline inspection system located in said printing press.

2. The method of claim 1, further including determining said level of print quality of said multicolor printed image applied to said print substrate end determined by the first measuring device during the setup phase of the printing press, remote from the printing press.

3. The method of claim 1, further including, during the setup phase of the printing press, acquiring said first actual value of said multicolor printed image, using said first measuring device, on each of a plurality of copies of the print substrate that have been provided with said multicolor printed image, calculating a mean value of these actual values of said multicolor printed image, and using this calculated mean value for adjusting the application of said multicolor printed image on the print substrate.

4. The method of claim 1, further including acquiring a limited number of said initial ones of said second actual values, each corresponding to said level of print quality of said multicolor printed image applied to said print substrate during said production run and implemented during the setup phase, using the second measuring device, calculating a mean value from this limited number of said initial ones of second actual values, and setting this mean value in the adjustment device as its established setpoint value.

5. The method of claim 1, further including transmitting the at least one first actual value, determined by the first measuring device during the setup phase of the printing press, by electronic data transmission to a central control console of the printing press.

6. The method of claim 1, further including using the adjustment device for signaling the detected deviations of the subsequent other ones of said second actual values; determined during the production run of the printing press, from the established setpoint value.

7. The method of claim 1, further including one of displaying on the adjustment device the detected deviations of the subsequent other ones of said second actual values, determined during the production run of the printing press, from the established setpoint value on a display device and signaling said deviation using a signaling device.

8. The method of claim 1, further including using the adjustment device for controlling the determined deviations of the subsequent other ones of said second actual values, determined during the production run of the printing press, from the established setpoint value one of automatically and only following a manual confirmation.

9. The method of claim 1, further including using the adjustment device for providing an indication of the determined deviations of the subsequent other ones of said second actual values, determined during the production run of the printing press, from the established setpoint value; and one of displaying, signaling and controlling these determined deviations, only when reaching or exceeding a preset tolerance limit for the degree of deviation.

* * * * *

UNITED STATES PATENT AND TRADEMARK OFFICE

CERTIFICATE OF CORRECTION

PATENT NO. : 8,001,898 B2
APPLICATION NO. : 12/225427
DATED : August 23, 2011
INVENTOR(S) : Türke et al.

It is certified that error appears in the above-identified patent and that said Letters Patent is hereby corrected as shown below:

In the claims:

Column 13, claim 2, line 28, after “substrate”, “end” should be --and--; and

Column 14, claim 9, line 35, after “value”, the “;” should be a --,--.

Signed and Sealed this
Twenty-fifth Day of October, 2011

David J. Kappos

David J. Kappos
*Director of the United States Patent and Trademark Office*